US007340839B2

(12) United States Patent
Oh

(10) Patent No.: US 7,340,839 B2
(45) Date of Patent: Mar. 11, 2008

(54) HAIR CLIPPER HAVING MOVING LOWER BLADE

(76) Inventor: Tae-Jun Oh, Bupyeong6-ri, Jingeop-eup, Namyangju-shi, 472-864 Gyeonggi-do (KR)

( * ) Notice: Subject to any disclaimer, the term of this patent is extended or adjusted under 35 U.S.C. 154(b) by 0 days.

(21) Appl. No.: 11/654,408

(22) Filed: Jan. 17, 2007

(65) Prior Publication Data

US 2007/0193034 A1 Aug. 23, 2007

(30) Foreign Application Priority Data

Feb. 21, 2006 (KR) ..... 20-2006-0004789

(51) Int. Cl.
*B26B 19/02* (2006.01)
*B26B 19/12* (2006.01)
*B26B 19/00* (2006.01)

(52) U.S. Cl. ..... 30/210; 30/208; 30/209; 30/215; 30/216; 30/217; 30/219; 30/223

(58) Field of Classification Search ..... 30/208–212, 30/215–219, 223, 203, 194, 43.91
See application file for complete search history.

(56) References Cited

U.S. PATENT DOCUMENTS 2,630,628 A * 3/1953 Hall ..... 30/216
6,141,878 A * 11/2000 Eslambolchi et al. ..... 30/216

* cited by examiner

*Primary Examiner*—Joseph J. Hail, III
*Assistant Examiner*—Bryan R. Muller
(74) *Attorney, Agent, or Firm*—Cantor Colburn LLP

(57) ABSTRACT

Disclosed is a hair clipper having a moving lower blade, in which the lower blade moves so that upper and lower blades reciprocate in opposite directions and cross each other. In the hair clipper, an eccentric cam is connected to a rotary shaft of a motor installed in a main body, and an eccentric shaft formed on the eccentric cam is inserted into a fixing groove formed in an upper blade fixing plate and vibrates horizontally, the lower blade is mounted on a blade support, such that the lower blade can move horizontally, and is fixed to one end of a link, the central portion of which is fixed to the blade support, and the other end of which is fixed to the lower surface of an upper blade fixing plate, to which an upper blade is fixed, and thus, when the upper blade fixing plate vibrates horizontally by the rotation of the motor, the lower blade vibrates on the blade support by the link in the direction opposite to the vibration of the upper blade.

3 Claims, 6 Drawing Sheets

HAIR CLIPPER HAVING MOVING LOWER BLADE

BACKGROUND OF THE INVENTION

1. Field of the Invention

The present invention relates to a hair clipper having a moving lower blade, and more particularly to a hair clipper, in which a lower blade moves so that upper and lower blades reciprocate in opposite directions and cross each other.

2. Description of the Related Art

A conventional hair clipper includes a lower blade fixed to a blade support, and an upper blade reciprocating on the lower blade.

A cutting portion formed on the front end of the lower blade of the hair clipper may inflict injury on a skin, thus being not sharpened. However, a dull cutting portion causes a problem in that hairs do not easily enter saw teeth, thus being incapable of cleanly trimming the hairs.

In the conventional hair clipper, the lower blade is fixed and the upper blade reciprocates. In order to perform the reciprocating motion, a vibrator rapidly vibrates. Further, in order to perform the rapid vibration, a motor excessively rapidly rotates, and is overheated, thus being damaged. The damage of the motor causes the shortening of the life span of the hair clipper.

SUMMARY OF THE INVENTION

Therefore, the present invention has been made in view of the above problems, and it is an object of the present invention to provide a hair clipper, in which upper and lower blades reciprocate in opposite directions so that hairs easily enter a gap between cutting portions of the upper and lower blades, and, even when a motor is driven at a low speed, cause the same cutting effect as usual.

In accordance with the present invention, the above and other objects can be accomplished by the provision of a hair clipper having a moving lower blade, in which an eccentric cam is connected to a rotary shaft of a motor installed in a main body and an eccentric shaft formed on the eccentric cam is inserted into a fixing groove formed in an upper blade fixing plate and vibrates horizontally, wherein the lower blade is mounted on a blade support, such that the lower blade can move horizontally, and is fixed to one end of a link, the central portion of which is fixed to the blade support, and the other end of which is fixed to the lower surface of an upper blade fixing plate, to which an upper blade is fixed, and thus, when the upper blade fixing plate vibrates horizontally by the rotation of the motor, the lower blade vibrates on the blade support by the link in the direction opposite to the vibration of the upper blade.

Preferably, the upper blade fixing plate is provided with a lower surface to which the upper blade is fixed, and includes a link fixing protrusion, which is formed on the center of the lower surface thereof and is inserted into an upper blade fixing hole of the link, and spring fixing holes, which are respectively formed through both sides of the front end of the upper surface thereof, ends of a vibration spring being respectively fixedly inserted into the spring fixing holes; the link includes a lower blade fixing hole formed through one end thereof, the upper blade fixing hole formed through the other end thereof, and a rotational center hole formed through the center thereof; the blade support includes a link fixing protrusion, which is formed on the center of the upper surface thereof and is inserted into the rotational center hole of the link, a locking protuberance formed along the circumferential surface of the link fixing protrusion, and guide protrusions formed at both sides of the link fixing protrusion; and the lower blade includes guide grooves respectively formed at both sides thereof so that the lower blade moves horizontally under the condition that the guide protrusions of the blade support are inserted into the guide grooves, a link fixing protrusion moving groove formed between the guide grooves for preventing the link fixing protrusion from interfering with the lower blade when the lower blade moves horizontally, and a link connecting protrusion formed on the center of the upper surface thereof and fixedly inserted into the lower blade fixing hole of the link.

More preferably, the vibration spring includes a hook portion formed at the central region thereof and caught on a spring fixing protrusion formed on the blade support, spring portions formed at both sides of the hook portion, and fixing terminals formed at the ends of the spring portions and fixedly inserted into the spring fixing holes of the upper blade fixing plate.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
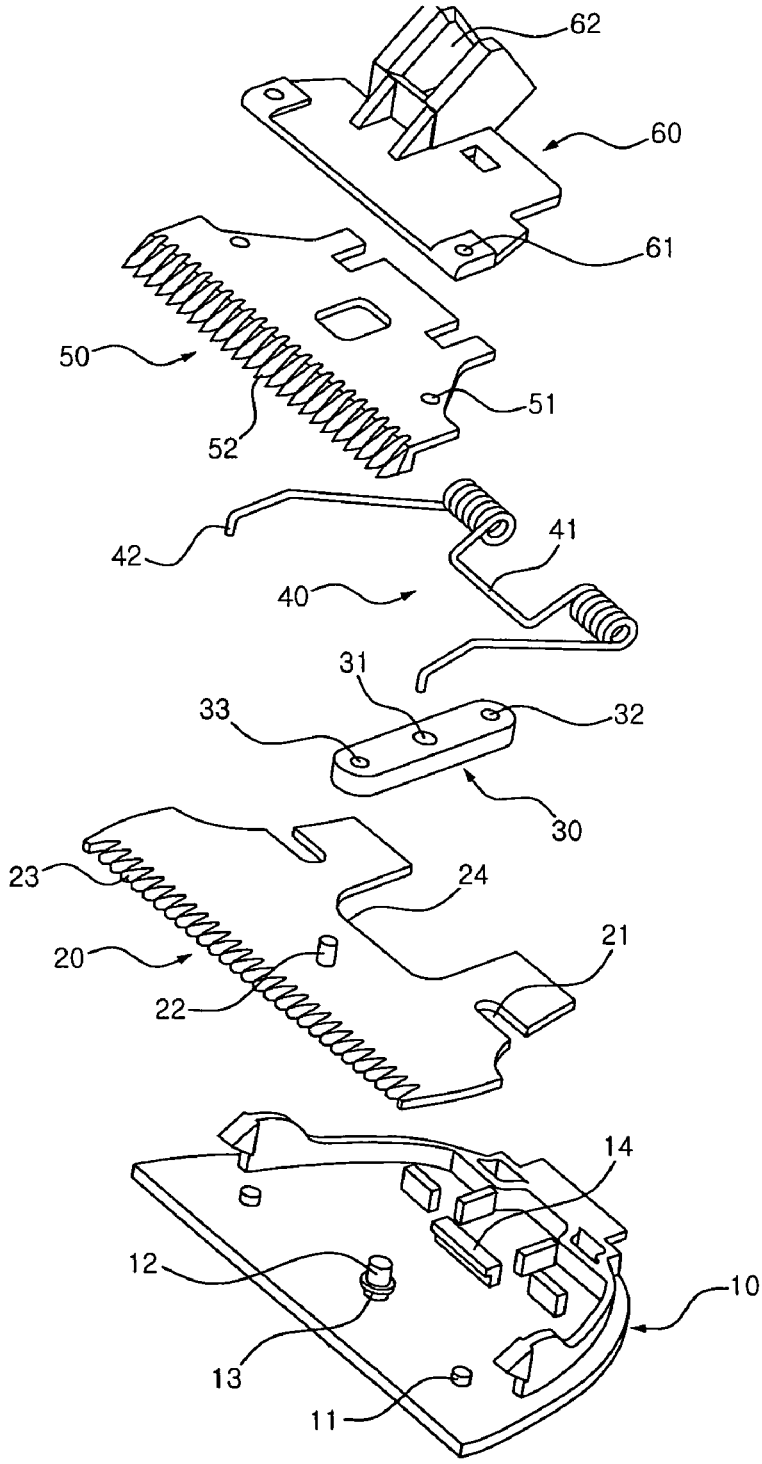
FIG. 1 is an exploded perspective view of a hair clipper having a moving lower blade in accordance with the present invention.
Figure 2:
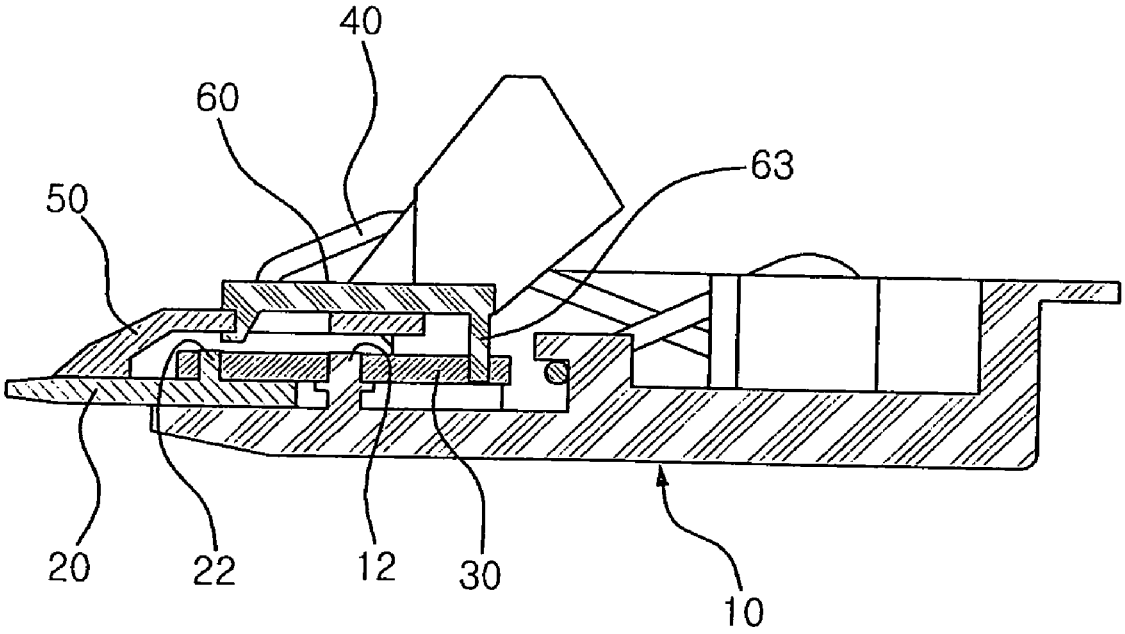
FIG. 2 is a head part of the hair clipper of the present invention.
Figure 3:
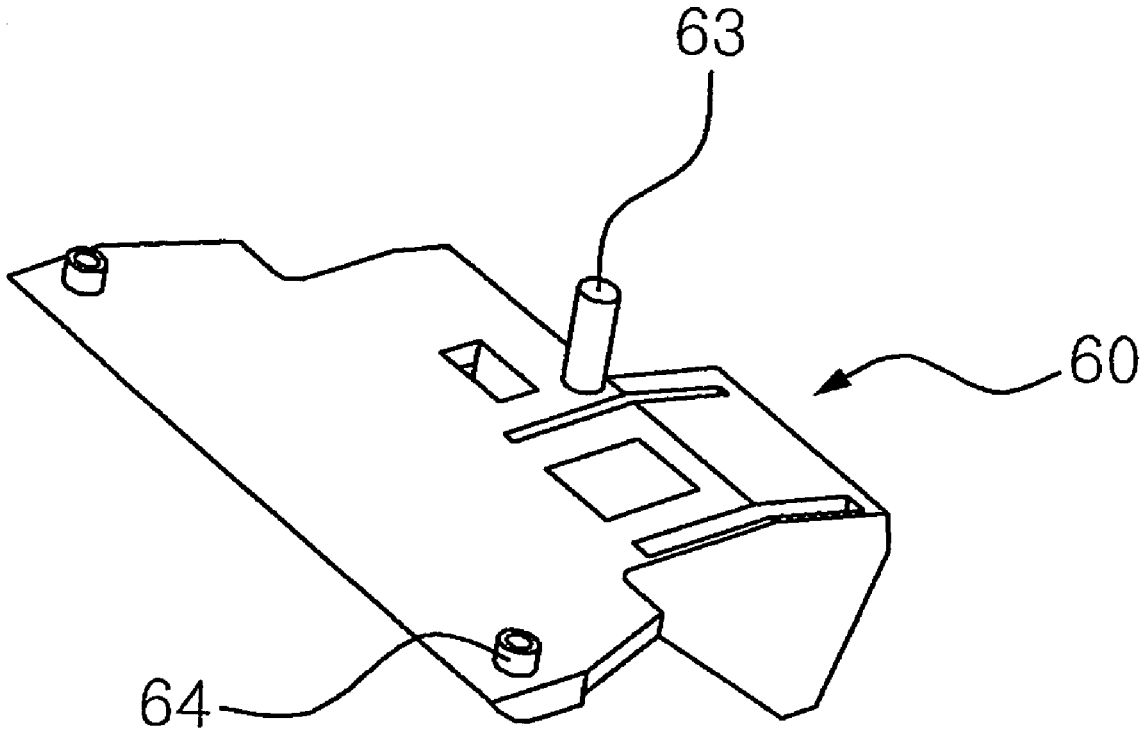
FIG. 3 is a perspective view illustrating a lower surface of an upper blade fixing plate of the hair clipper of the present invention.
Figure 4:
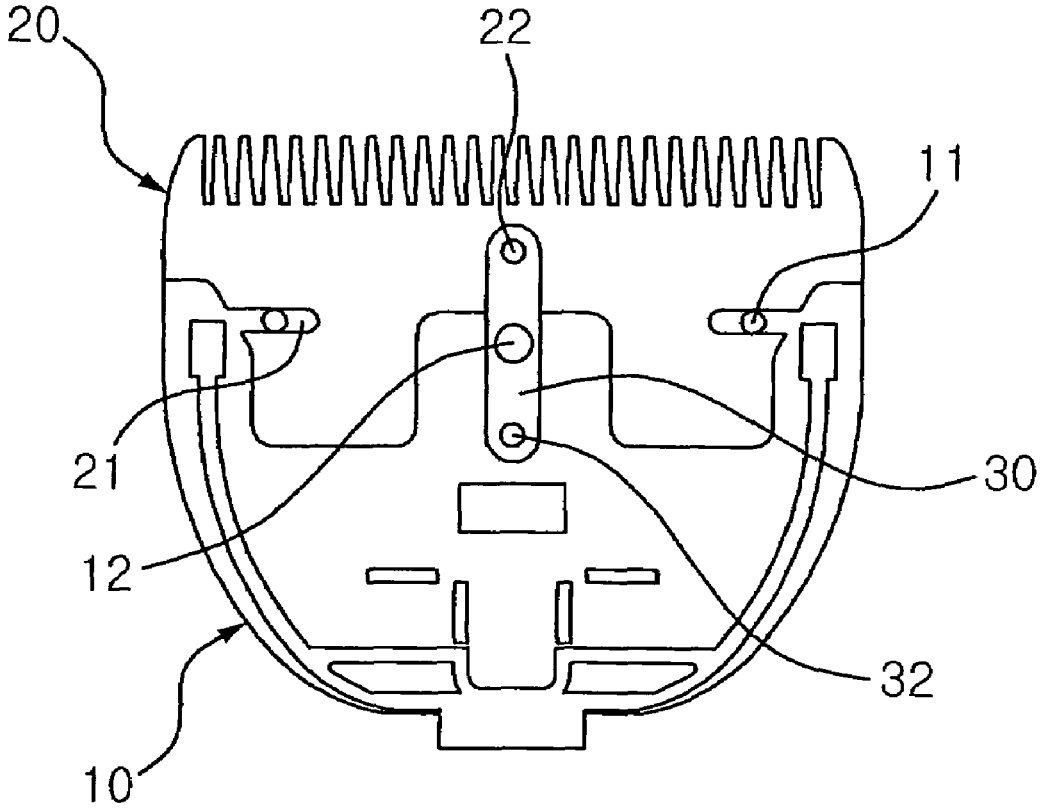
FIG. 4 is a plan view illustrating the hair clipper of the present invention in a state in which a blade support, the lower blade, and a link are assembled.
Figure 5:
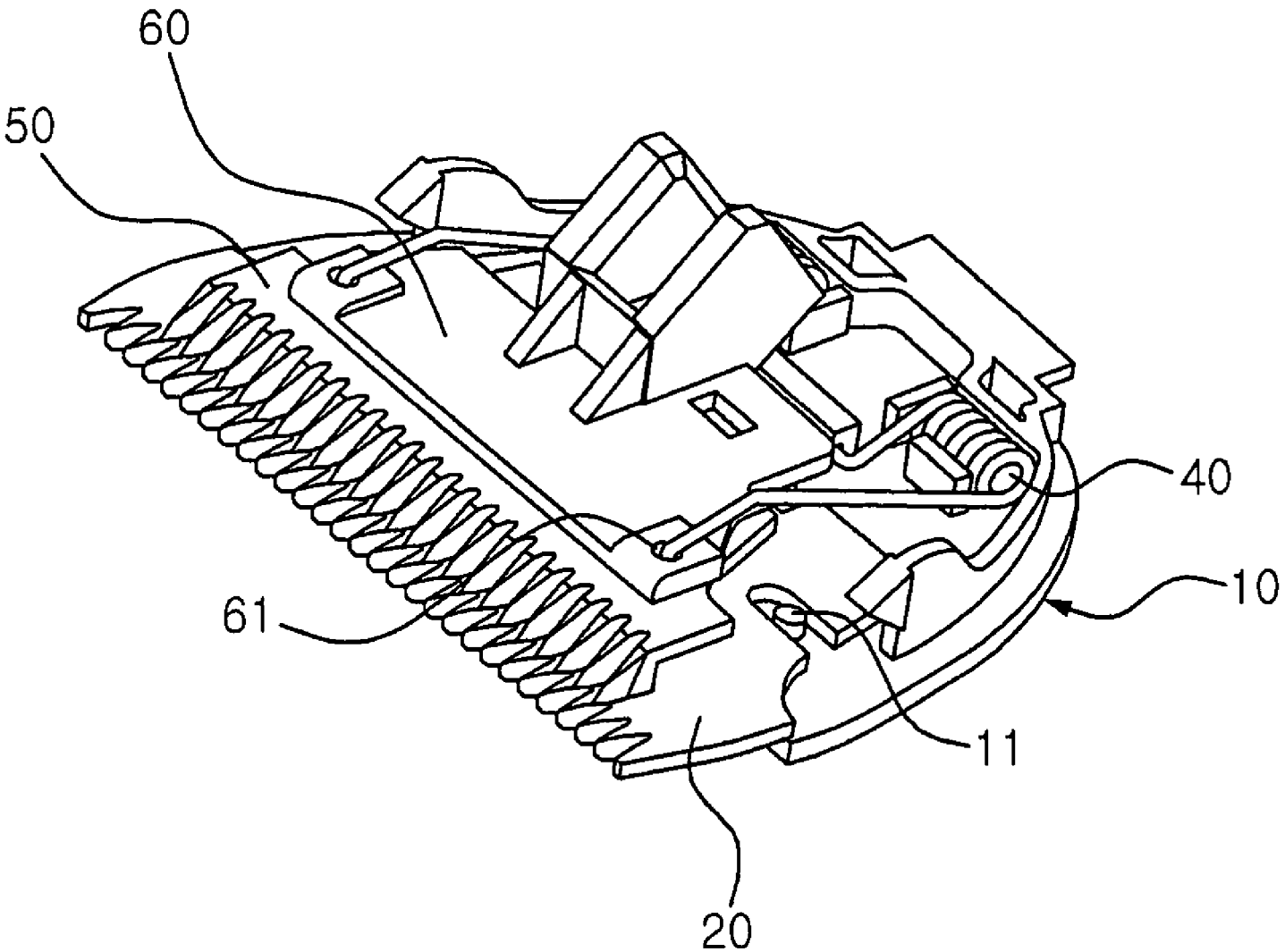
FIG. 5 is a perspective view of the head part of the hair clipper of the present invention in an assembled state.
Figure 6:
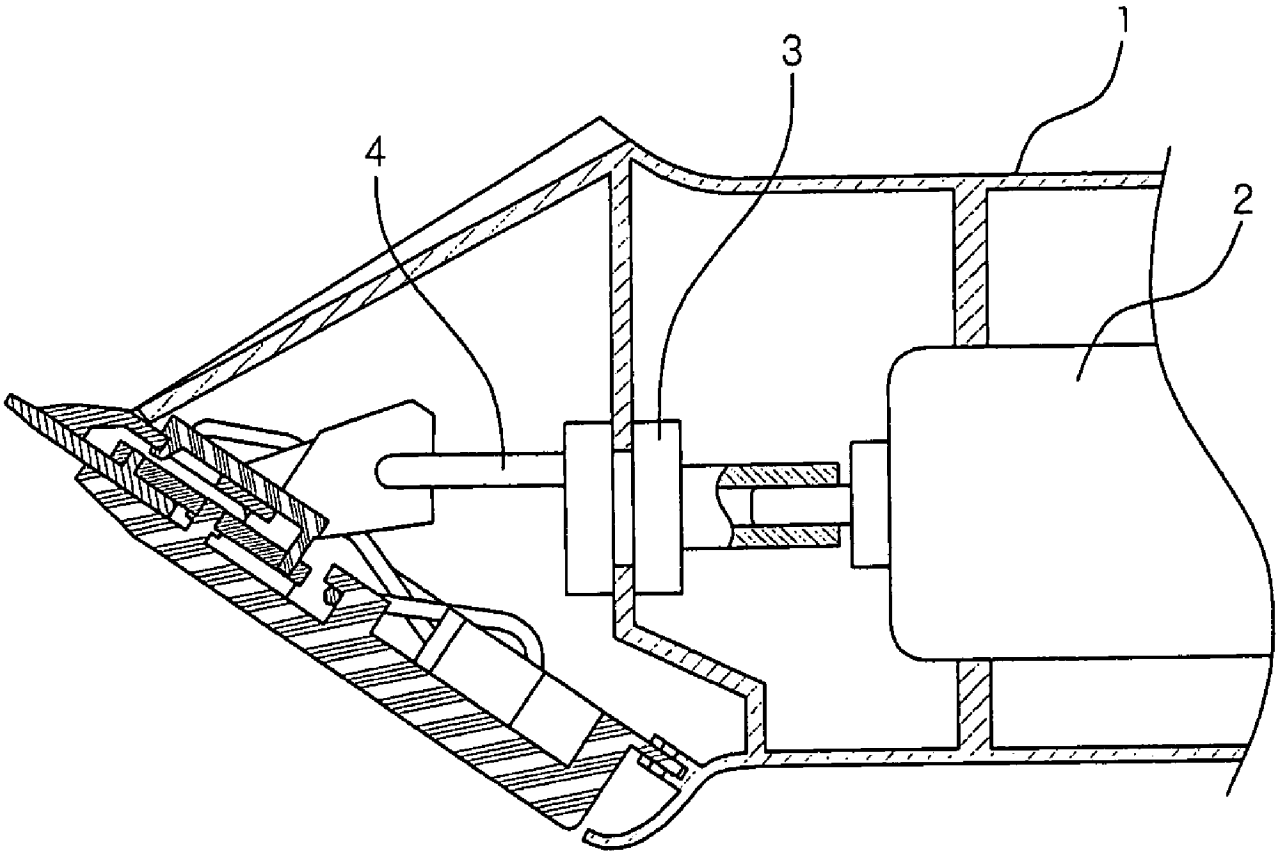
FIG. 6 is a sectional view of the hair clipper of the present invention.

Now, a preferred embodiment of the present invention will be described in detail with reference to the annexed drawings.

Terms or words, which will be used in the description and the claims, are not limitedly interpreted as conventional or dictionary meanings, but must be interpreted as meanings corresponding to the technical spirit of the invention, based on a principle in which the inventor can properly define the meaning of terms for describing the invention in the best mode.

A hair clipper in accordance with the present invention is configured in that a motor 2 is installed in a main body 1, an eccentric cam 3 is connected to a rotary shaft of the motor 2, and an eccentric shaft 4 formed on the eccentric cam 3 is inserted into a fixing groove 62 formed in an upper blade fixing plate and vibrates horizontally.

A lower blade 20 is mounted on a blade support 10 such that the lower blade 20 can move horizontally, and is fixed to one end of a link 30, the central portion of which is fixed to the blade support 10. The other end of the link 30 is fixed to the lower surface of an upper blade fixing plate 60, to which an upper blade 50 is fixed. When the upper blade fixing plate 60 vibrates horizontally by the rotation of a motor 2, the lower blade 20 vibrates on the blade support 10 by the link 30 in the direction opposite to the vibration of the upper blade 50.

The link 30 guides the reciprocating movement of the lower blade 20 and the upper blade 50, and includes a lower blade fixing hole 33 formed through one end thereof, an upper blade fixing hole 32 formed through the other end thereof, and a rotational center hole 31 formed through the center thereof.

The upper blade 50 is fixed to the lower surface of the upper blade fixing plate 60. The upper blade fixing plate 60 includes a link fixing protrusion 63, which is formed on the center of the lower surface thereof and is inserted into the upper blade fixing hole 32 of the link 30 and blade fixing protrusions 64 formed on the sides of the lower surface thereof that are inserted into fixing holes 51 in the upper blade. The upper blade fixing plate 60 further includes spring fixing holes 61, which are respectively formed through both sides of the front end of the upper surface thereof. Fixing terminals 42 formed at ends of a vibration spring 40 are respectively fixedly inserted into the spring fixing holes 61.

The blade support 10, on which the lower blade 20 is mounted, includes a link fixing protrusion 12, which is formed on the center of the upper surface thereof and is inserted into the rotational center hole 31 of the link 30, and a locking protuberance 13 formed along the circumferential surface of the link fixing protrusion 12. The locking protuberance 13 serves as a unit for adjusting the height of the link 30 such that the link 30 is protruded from the lower blade 20.

Guide protrusions 11 are respectively formed on the blade support 10 at both sides of the link fixing protrusion 12. The guide protrusions 11 guide the reciprocating motion of the lower blade 20.

Guide grooves 21 are respectively formed at both sides of the lower blade 20. Under the condition that the guide protrusions 11 of the blade support 10 are inserted into the guide grooves 21, the lower blade 20 moves horizontally. Further, a link fixing protrusion moving groove 24 is formed between the guide grooves 21. When the lower blade 20 moves horizontally, the link fixing protrusion moving groove 24 prevents the link fixing protrusion 12 from interfering with the lower blade 20.

A link connecting protrusion 22 is formed on the center of the upper surface of the lower blade 20, and is fixedly inserted into the lower blade fixing hole 33 of the link 30.

The vibration spring 40 includes a hook portion 41, which is formed at the central region thereof and is caught on a spring fixing protrusion 14 of the blade support 10, spring portions formed at both sides of the hook portion 41, and the fixing terminals 42, which are formed at the ends of the spring portions and are fixedly inserted into the spring fixing holes 61 of the upper blade fixing plate 60.

Each of the spring portions is connected to the corresponding one of two fixing terminals 42, which are bent downwardly, and is coiled several times. The hook portion 41 having a U shape is formed between the two spring portions 43, and is caught on the spring fixing protrusion 14 formed on the blade support 10. The vibration spring 40 serves to supply elastic force as well as to hold the upper blade fixing plate 60, when the upper blade fixing plate 60 vibrates.

When the upper blade fixing plate 60 moves horizontally by the rotation of the motor 2, the upper blade 50 moves also. When the upper blade 50 moves in one direction, i.e., to the left, the lower blade 20 moves in the opposite direction, i.e., to the right, by means of the link 30. Accordingly, the upper blade 50 and the lower blade 20 simultaneously move horizontally in opposite directions and cutting teeth 52 on the upper blade cooperate with cutting teeth 23 on the lower blade to cut hairs.

As apparent from the above description, the present invention provides a hair clipper, in which upper and lower blades reciprocate in opposite directions at a low speed and cross each other, thus increasing hair cutting efficiency. Further, since the lower blade has a dull cutting portion so as not to inflict injury on the contact portion of a skin, hairs are easily inserted into the cutting portion. Thereby, the hair clipper has a high cutting effect.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A hair clipper having a moving lower blade comprising: an eccentric cam, which is connected to a rotary shaft of a motor installed in a main body and an eccentric shaft formed on the eccentric cam, which is inserted into a fixing groove formed in an upper blade fixing plate, the eccentric cam driving the fixing plate to vibrate horizontally, wherein the lower blade is mounted on a blade support, such that the lower blade can move horizontally, and is connected to one end of a link, the central portion of which is connected to the blade support, and the other end of which is connected to the lower surface of an upper blade fixing plate, an upper blade being fixed to the lower surface of the upper blade fixing plate, and thus, when the upper blade fixing plate vibrates horizontally by the rotation of the motor, the lower blade vibrates on the blade support in the direction opposite to the vibration of the upper blade by way of the link.

2. The hair clipper according to claim 1, wherein:

the upper blade fixing plate further includes a link fixing protrusion, which is formed on the center of the lower surface thereof and is inserted into an upper blade fixing hole of the link, and spring fixing holes, which are respectively formed through both sides of the front end of an upper surface thereof, ends of a vibration spring being respectively fixedly inserted into the spring fixing holes;

the link includes a lower blade fixing hole formed through one end thereof, the upper blade fixing hole formed through the other end thereof, and a rotational center hole formed through the center thereof;

the blade support includes a link fixing protrusion, which is formed on the center of the upper surface thereof and is inserted into the rotational center hole of the link, a locking protuberance formed along the circumferential surface of the link fixing protrusion, and guide protrusions formed on the upper surface of the blade support at both sides of the link fixing protrusion; and the lower blade includes guide grooves respectively formed at both sides thereof so that the lower blade moves horizontally under the condition that the guide protrusions of the blade support are inserted into the guide grooves, a link fixing protrusion moving groove formed between the guide grooves for preventing the link fixing protrusion from interfering with the lower blade when the lower blade moves horizontally, and a link connecting protrusion formed on a center of the upper surface of the lower blade and fixedly inserted into the lower blade fixing hole of the link.

3. The hair clipper according to claim 2, wherein the vibration spring includes a hook portion formed at a central region thereof that is positioned on a spring fixing protrusion formed on the blade support, spring portions formed at both sides of the hook portion, and fixing terminals formed at the ends of the spring portions and fixedly inserted into the spring fixing holes of the upper blade fixing plate.

* * * * *